US005085381A

United States Patent [19]

Spiroff et al.

[11] Patent Number: 5,085,381

[45] Date of Patent: Feb. 4, 1992

[54] DEPLOYABLE AERODYNAMIC AEROSURFACE

[75] Inventors: Carl M. Spiroff, Granite City, Ill.; Lawrence J. Long, St. Louis, Mo.; Ward F. Winkelmann, St. Charles, Mo.; Harold F. Steinmetz, St. Louis, Mo.

[73] Assignee: The United States of America as represented by the Secretary of the Air Force, Washington, D.C.

[21] Appl. No.: 677,060

[22] Filed: Mar. 29, 1991

[51] Int. Cl.[5] ..... F42B 13/32

[52] U.S. Cl. ..... 244/3.240; 244/3.29

[58] Field of Search ..... 244/3.24, 3.27, 3.28, 244/3.29

[56] References Cited

U.S. PATENT DOCUMENTS

| | | | |
|---|---|---|---|
| 2,924,175 | 2/1960 | Jasse | 244/3.29 |
| 2,925,966 | 2/1960 | Kongelbeck | 244/3.29 |
| 3,165,281 | 1/1965 | Gohlke | 244/49 |
| 3,273,500 | 9/1966 | Kongelbeck | 244/3.28 |
| 3,563,495 | 2/1971 | Korn | 244/3.27 |
| 4,158,447 | 1/1979 | Humphries et al. | 244/3.27 |
| 4,691,880 | 9/1987 | Frank | 244/3.24 |
| 4,717,093 | 1/1988 | Rosenberger et al. | 244/3.28 |
| 4,778,127 | 10/1988 | Duchesneau | 244/3.29 |
| 4,817,891 | 4/1989 | Gaywood | 244/3.23 |

*Primary Examiner*—Joseph F. Peters, Jr.
*Assistant Examiner*—Anne E. Bidwell
*Attorney, Agent, or Firm*—Edward W. Nypaver; Donald J. Singer

[57] ABSTRACT

An apparatus for and method of depolying a movable aerosurface of an aerial vehicle from a folded position to an unfolded, operative flight position. The aerosurface, such as a fin for example, includes a pivotal base member and a control surface connected to the base member for movement relative thereto. An actuator effects pivotal movement of the aerosurface at a predetermined angular rate of deployment. During the initial depolyment cycle the control surface is deflected relative to the base member in a direction and manner imparting aerodynamic forces against the aerosurface to accelerate the angular rate of deployment of the aerosurface. Thereafter, the control surface is deflected in a reverse direction during a later portion of the deployment cycle to impart aerodynamic forces for decelerating and dampening the angular rate of aerosurface deployment to reduce arresting loads as the aerosurface approaches its fully unfolded position.

12 Claims, 6 Drawing Sheets

DEPLOYABLE AERODYNAMIC AEROSURFACE

RIGHTS OF THE GOVERNMENT

The invention described herein may be manufactured and used by or for the Government of the United States for all governmental purposes without the Payment of any royalty.

BACKGROUND OF THE INVENTION

The present invention relates to an aerosurface deployment system and, more particularly, to an apparatus and method utilizing aerodynamic forces to effect and control deployment of pivotal aerosurface elements mounted on missiles and the like.

Rockets, missiles and like vehicles conventionally are provided with aerosurfaces, such as fins or wings for example, for stabilizing and controlling flight through the atmosphere. It is obvious that such laterally extending stabilizing aerosurfaces pose problems of space requirements and drag when the vehicle is stowed and carried by aircraft. In order to avoid these disadvantages, current missile designs employ aerosurfaces which are retractably mounted or folded adjacent the missile fuselage or body while stowed for storage and deployed upon launching for extending the fins into their operative flight positions.

Various aerosurface deployment mechanisms are known which use complex mechanical arrangements, springs, centrifugal force, or a combination of these mechanisms, to effect extensions of the stabilizing fins into flight positions. Such prior art devices are exemplified by U.S. Pat. Nos. 2,925,966 and 3,273,500 to Kongelbeck and U.S. Pat. No. 3,165,281 to Gohlke. While these known fin deployment arrangements have merit and are suited for their intended purpose, they possess certain disadvantages. For example, they often require complexly configurated components and connecting attachments which are expensive, cumbersome, promote drag, are vulnerable to jamming, and present problems in fabrication and assembly, sometimes requiring an inventory of a large number of different parts. Moreover, the high angular rate of deployment of such aerosurfaces results in an enormous, if not intolerable, end-of-stroke arresting load that could incur severe damage to the aerosurfaces.

SUMMARY OF THE INVENTION

Accordingly, it is a primary object of the present invention to avoid the above noted shortcomings by providing an improved apparatus for and method of deploying an aerosurface by utilizing aerodynamic loads to effect extension of a folded aerosurface.

It is another object of this invention to induce controlled deflection of the aforementioned aerosurface by efficiently utilizing aerodynamic loads for sequentially initiating and then retarding aerosurface deployment.

It is still another object of the present invention to provide an actuating mechanism in combination with aerodynamic loads to effect rapid deployment of a folded aerosurface into an operative flight position within minimum time constraints.

It is a further object of this invention to utilize the foregoing combination for initially accelerating deployment of a folded aerosurface and thereafter decelerating deployment to provide minimal end-of-stroke arresting load as the aerosurface reaches its fully deployed position.

It is still a further object of the present invention to provide an aerosurface deployment actuating mechanism completely enclosed within the fairing of an aerial vehicle and which is simple and strong in construction, durable and rugged in use, requires a minimum of parts, and is reliable in operation.

The foregoing and other objects, advantages, and characterizing features of this invention will become clearly apparent from the ensuing detailed description thereof considered in conjunction with the accompanying drawings wherein like reference numerals denote like parts throughout the various views.

In accordance with the present invention, an apparatus and method is provided for deploying a pivotal aerosurface, such as a wing or fin, from a folded or stowed position to an unfolded or fully deployed position. The apparatus includes a mechanism to control deflection of a control surface on the aerosurface after initial movement thereof in a direction and manner inducing aerodynamic loads to assist and accelerate the deployment rate of the aerosurface during the first portion of the deploying cycle. Reverse control surface movement is initiated during a later portion of the deployment cycle to decelerate the deployment rate and aid in smoothly halting movement of the aerosurface at its fully unfolded, deployed position with a minimal arresting load.

BRIEF DESCRIPTION OF THE DRAWING FIGURES

DETAILED DESCRIPTION OF AN ILLUSTRATIVE EMBODIMENT

Figure 1:
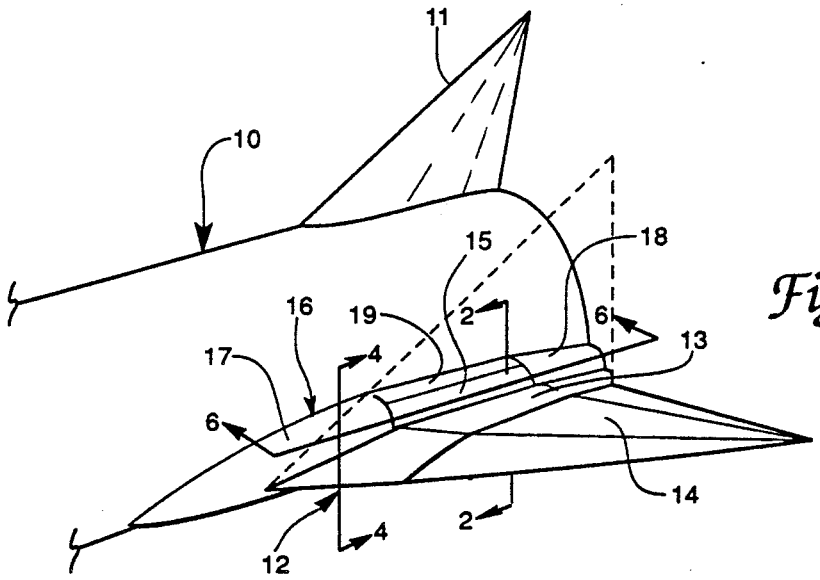
FIG. 1 is a perspective view of the aft section of an aerial vehicle provided with a pivotally movable fin shown in an unfolded, operative flight position.

Referring now in detail to the illustrative embodiment depicted in the accompanying drawings, there is shown in FIG. 1 the aft section of a guided missile, comprehensively designated 10, provided with two fixed aerosurfaces 11 and two pivotal aerosurfaces, also referred to as fins, generally designated 12 (only one of each being shown in FIG. 1), embodying certain novel features of this invention. While apparatus 10 is conveniently identified as a missile, it should be appreciated that the invention hereinafter described is applicable to any aerial vehicle such as rockets, projectiles, aerodynes and the like. The deployable fins 12 are pivotally mounted about axes extending lengthwise of missile 10 at opposite sides thereof between a folded or stowed position shown in dotted lines in FIG. 1 and an unfolded or deployed extended flight position shown in full lines. If desired or required, any number of deployable fins 12 can be employed, preferably in a laterally symmetrical arrangement about missile 10.

Figure 2:
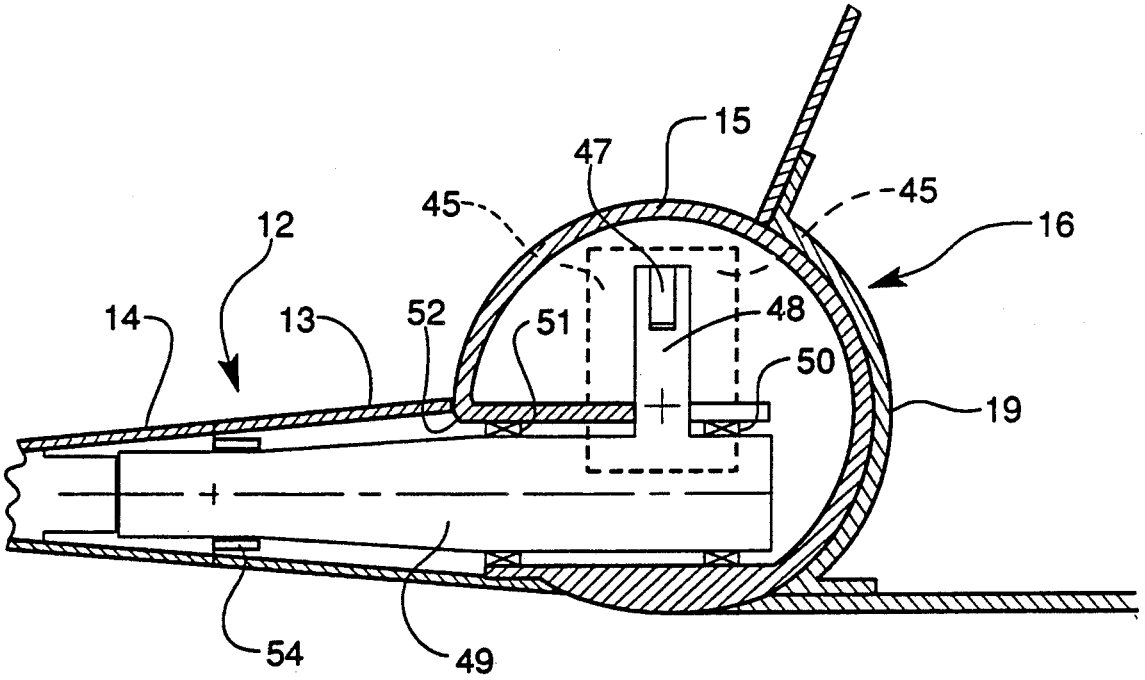
FIG. 2 is a fragmentary vertical sectional view taken about on line 2—2 of FIG. 1.
Figure 3:
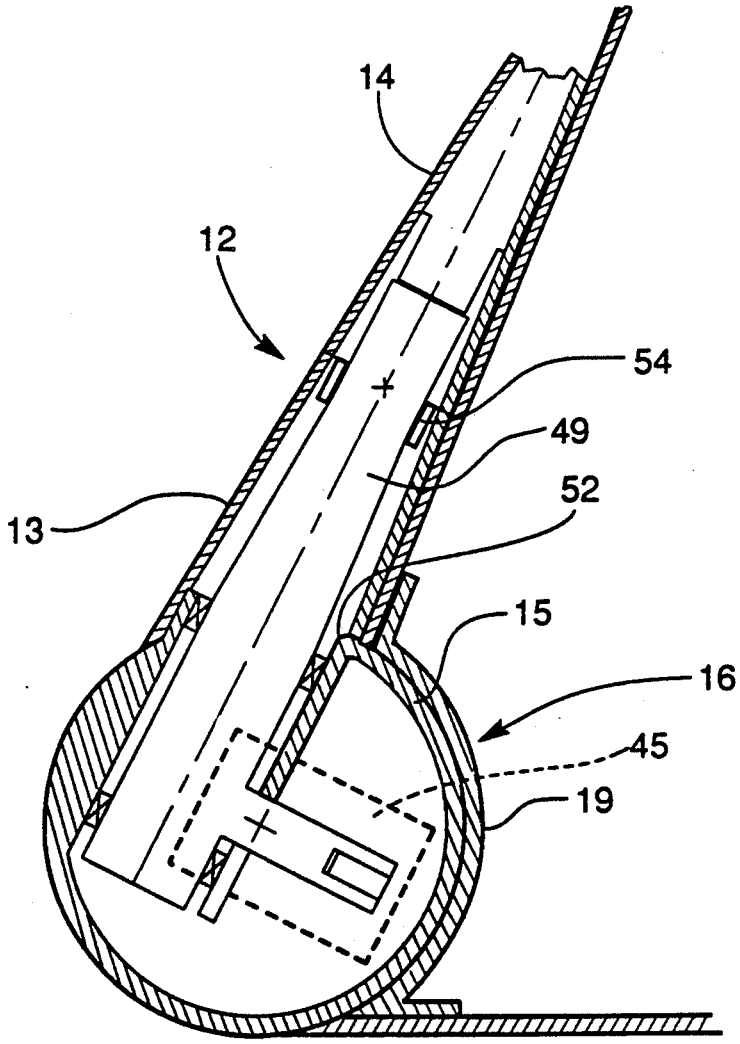
FIG. 3 is a sectional view similar to FIG. 2 showing the movable fin in a stowed or folded position.

Each fin 12 comprises a root or base member 13 and a control surface 14 movable relative to the base member 13 about an axis normal to the axis about which base member 13 pivots. The base member 13 is suitably rigidly secured to a rotatable housing 15 forming a part of the missile fairing 16 and nestled between fairing fixed portions 17 and 18. As shown in FIGS. 2 and 3, the housing 15 is generally cylindrical in shape and rotates within an arcuately shaped fixed canopy 19 of the fairing 16 and relative to the fairing fixed portions 17 and 18 (FIG. 1). With this arrangement, the cylindrical housing 15 smoothly blends in with fairing 16 while providing efficient packaging for the aerosurface control actuating means, hereinafter described in detail, thereby avoiding any hardware from projecting into the airstream and the resultant drag associated therewith.

Figure 4:
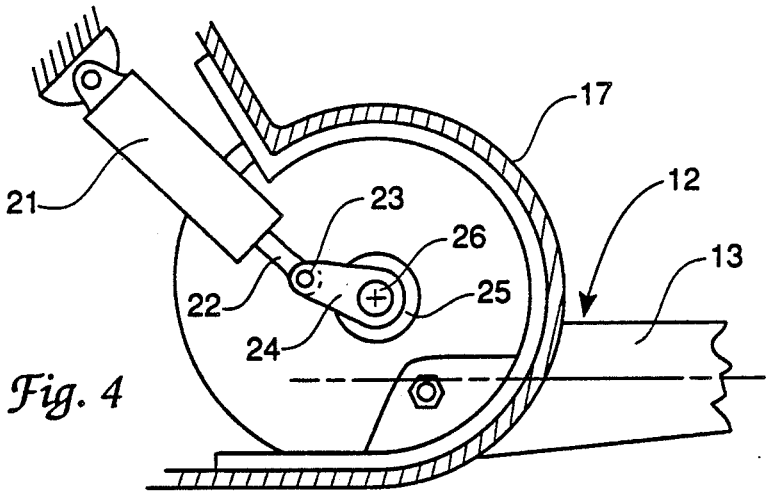
FIG. 4 is a fragmentary vertical sectional view taken about on line 4—4 of FIG. 1 showing the actuator for initiating movement of the aerosurface, which is shown in the deployed, flight position in this figure.
Figure 5:
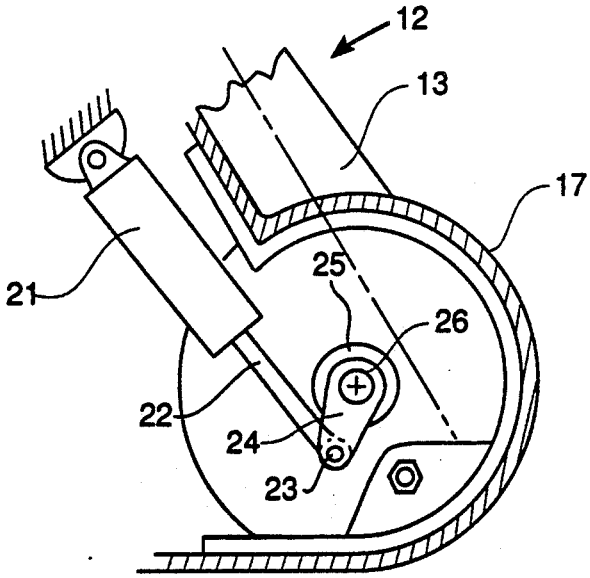
FIG. 5 is a sectional view similar to FIG. 4 illustrating the actuator in an alternate position prior to deployment of the aerosurface.
Figure 6:
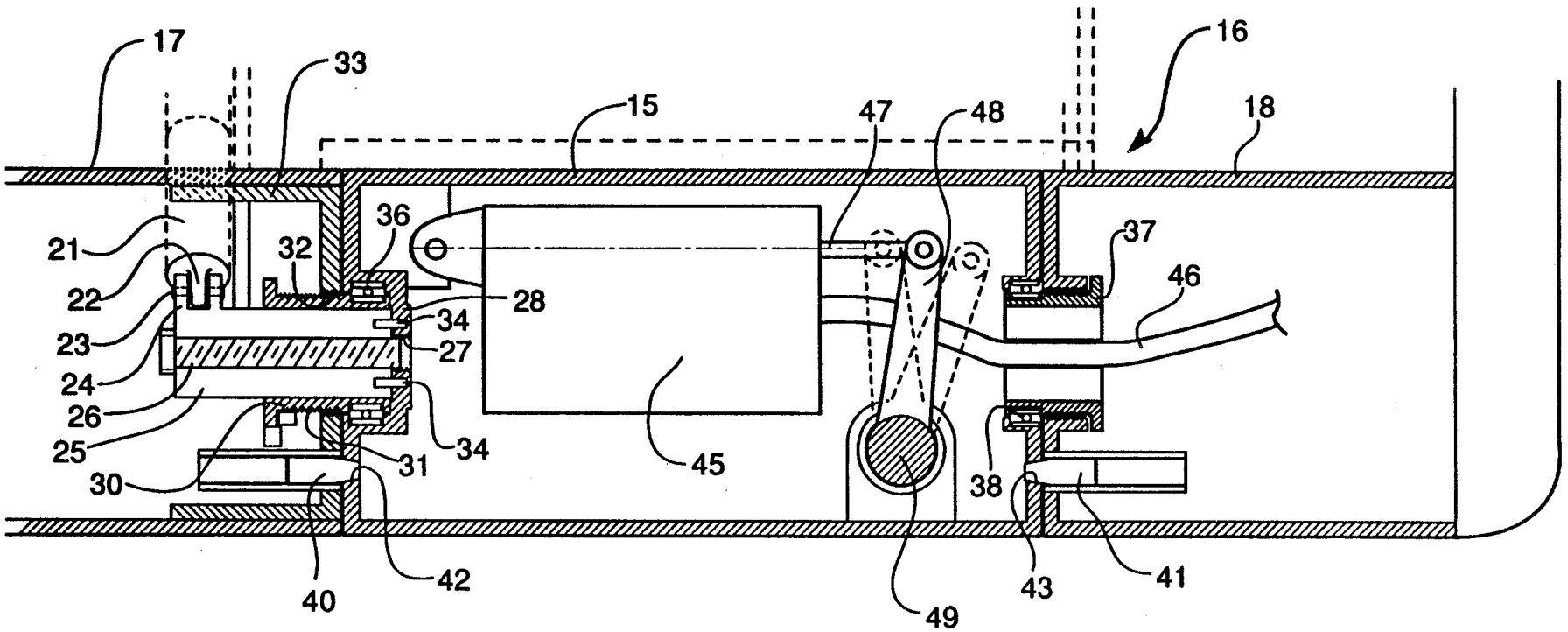
FIG. 6 is a fragmentary horizontal sectional view taken along line 6—6 of FIG. 1.

As best shown in FIGS. 4, 5, and 6, the means for pivoting or deploying fin 12 from the folded or stowed position to its unfolded or extended position includes an actuator 21, such as an explosive pyrotechnic device or stored gas driven arrangement for example, suitably secured at its head end within the missile airframe and provided with a piston rod 22 pivotally secured, as at 23, to a bellcrank arm 24. The arm 24 is formed with a cylindrical extension 25 secured to the housing 15 by a bolt 26 threaded into a tapped opening 27 formed in a recessed wall 28 of the housing 15. The extension 25 is journalled for rotation in a sleeve bearing 30 having external threads 31 for engagement with a threaded opening 32 formed in the end wall of a support member 33 rigidly secured within the fairing fixed end support 17. Circumferentially spaced torque pins 34 are received in the end face of extension 25 and extend into the housing recessed wall 28 to transmit the torque from extension 25 to housing 15. A bearing 36 is provided between the distal end of fixed sleeve 30 and housing 15 to facilitate relative rotation therebetween. The other end of rotatable housing 15 is provided with an opening for receiving a bushing 37 rigidly secured to the fairing fixed end support 18. A bearing 38 is disposed between the fixed bushing 37 and housing 15 to permit relative rotation therebetween. Thus, the rotation imparted to extension 25 is transmitted to the housing 15 which rotates relative to the fairing fixed end portions 17 and 18.

Spring loaded lock pins 40 and 41 are mounted within the fairing fixed end portions 17 and 18 for insertion into openings 42 and 43 formed in the opposite end faces of rotatable housing 15. As will hereinafter become more evident, the lock pins 40, 41 are retained in a retracted position when the fin 12 is in its stowed position and become operative for insertion into their respective openings 42, 43 when fin 12 is fully deployed to lock the same in its extended flight position.

Figure 7:
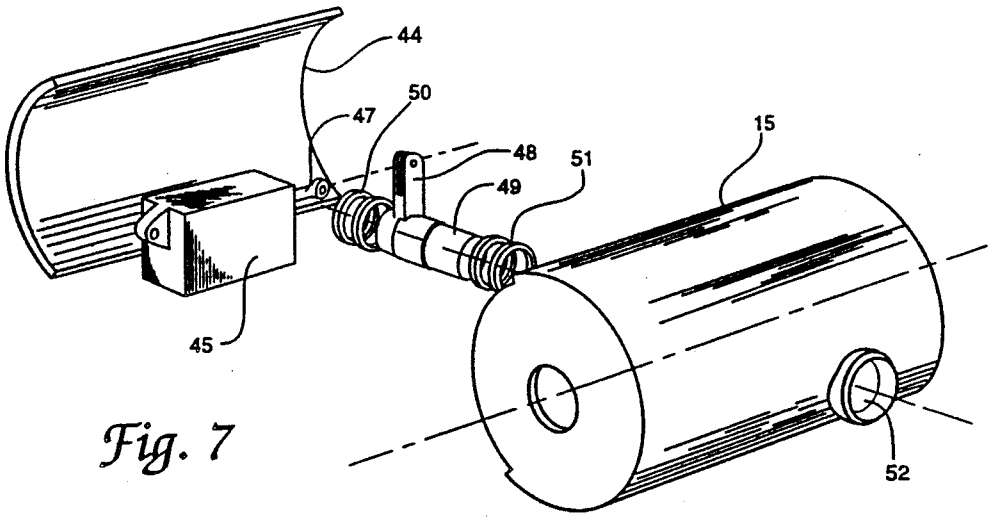
FIG. 7 is an exploded perspective view of the rotatable housing for the internal drive arrangement forming a part of this invention.

The rotatable housing 15 encloses means for actuating the control surface 14 into selected angular positions relative to the fin base member 13 to generate aerodynamic forces augmenting or assisting in the deployment of the stabilizer fin 12. A removable panel or door 44 (FIG. 7) is provided on housing 15 to provide access to various parts of such actuating means, hereinafter described, contained in housing 15. As best illustrated in FIGS. 6 and 7, such activating means includes an electro-mechanical actuator 45 rigidly mounted within rotatable housing 15 for movement therewith and connected by means of a conductor 46 to a suitable source of electrical power (not shown) located within the missile airframe. The conductor 46 passes through the fixed end portion 18 of fairing 16 and through bushing 37 to the actuator 45. The actuator 45 is provided with a connecting rod 47 attached to a bellcrank 48 integral with or otherwise fixedly secured to a control drive shaft 49 journalled for rotation in spaced bearings 50 and 51 suitably mounted in rotatable housing 15. As shown in FIGS. 2 and 3, the shaft 49 extends transversely of housing 15, projecting through a suitable opening 52 therein and through the fin base member 13 for attachment to the control surface 14 by connecting means, generally designated 53, hereinbelow described.

Figure 8:
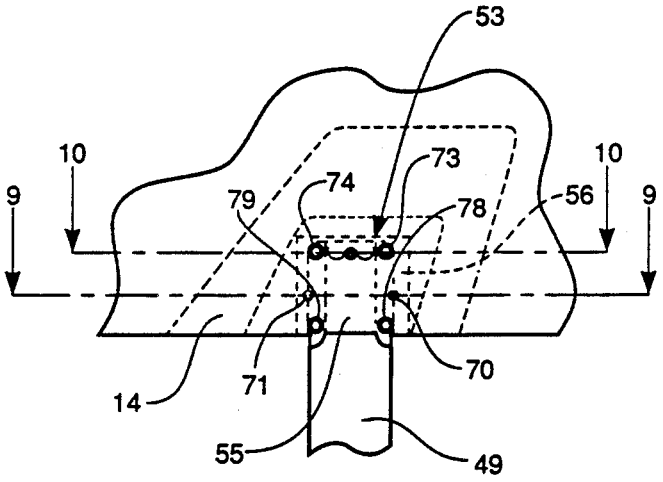
FIG. 8 is a fragmentary plan view illustrating the means for connecting a drive shaft to the control surface of a fin.
Figure 9:
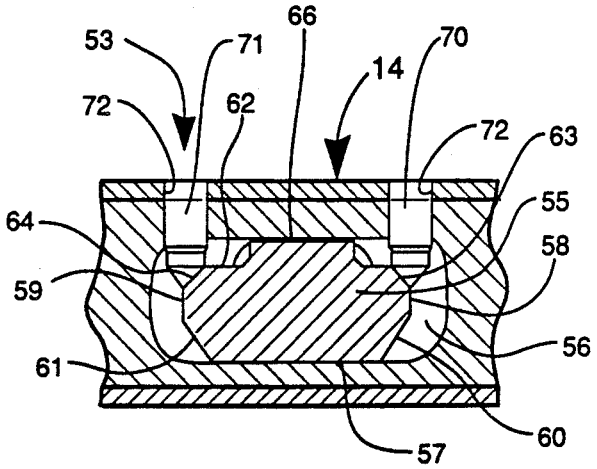
FIG. 9 is a fragmentary vertical sectional view taken about on line 9—9 of FIG. 8.
Figure 10:
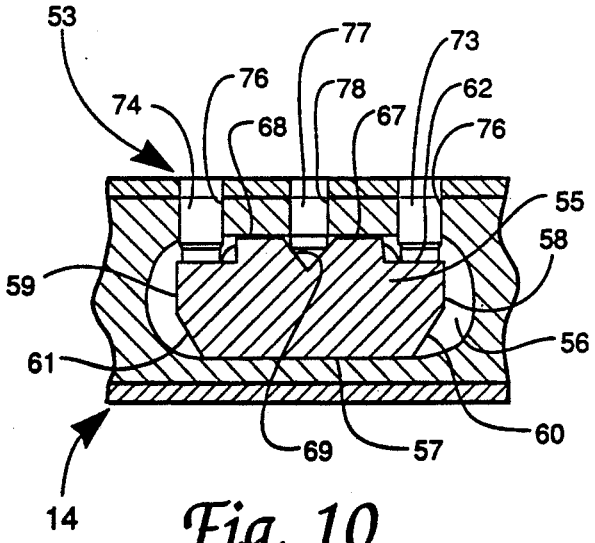
FIG. 10 is a fragmentary vertical sectional view taken along line 10—10 of FIG. 8.

Shaft 49 is rotatably mounted within base section 13 by a sleeve bearing 54. The shaft 49 terminates in a reduced width end portion 55 (FIG. 8) received in a recess 56 formed in control surface 14. As shown in FIGS. 9 and 10, end portion 55 has an irregular configuration in cross section comprising a flat bottom wall 57, a pair of straight opposite side walls 58 and 59 joined to the bottom wall 57 by sloping portions 60 and 61. End portion 55 is formed with a flat top surface 62 joined to side walls 58 and 59 along a major portion thereof by beveled surfaces 63 and 64 (FIG. 9). An embossment 66 is provided centrally of surface 62 and is formed to terminate in a pair of projections 67 and 68 (FIG. 10) having inclined inner surfaces which extend downwardly in converging relation to form a generally conically shaped opening 69 therebetween. A pair of cone tipped alignment set screws 70 and 71 (FIG. 9) are inserted through suitable tapped openings 72 formed in control surface 14 for engagement with and between the beveled surfaces 63 and 64 and the side walls defining recess 56 approximately midway of portion 55. A pair of flat bottom set screws 73 and 74 (FIG. 10) are threaded into tapped openings 76 provided in control surface 14 adjacent the rear end of portion 55 for abutment against the upper flat surface 62 of portion 55. A central cone tipped set screw 77 is inserted through tapped opening 78 for mating engagement into the conically shaped opening 69 formed between projections 67 and 68. Also, a second pair of flat bottom set screws 78 and 79, similar to screws 73 and 74, are threaded into suitable tapped openings (not shown) provided in control surface 14 adjacent the forward end of portion 54. Thus, the end portion 54 of shaft 49 is slidably received in recess 55 and fixed in its selected position by means of the several alignment set screws described above. It should be understood that this invention is in no manner restricted in use to the specific connecting means 53 illustrated and described above, but contemplates any suitable attachment arrangement for adjustably connecting the drive shaft 49 to control surface 14.

In operation, the deployment or unfolding cycle of stabilizer fin 12 is initiated by activation of actuator 21 which effects rotation of housing 15 along with fin 12 carried thereby. As the fin 12 starts to move out of its stowed position into the deployment sequence, the control surface actuator 45 is energized via conductor 46 connected to a suitable source of electrical power and controlled by the missile guidance, navigation, and control system (not shown). Activation of actuator 45 shifts rod 47 toward the left as viewed in FIG. 6 to effect rotation of bellcrank 48 and thereby the drive shaft 49 in a counterclockwise direction to deflect the control surface 14 relative to base member 13 at an angular rate of 150° per second until the control surface 14 attains a maximum deflection of 2°. This control surface deflection induces an aerodynamic load or force, identified as F in FIG. 11, acting on fin 12 to accelerate and assist in the unfolding thereof.

Figure 12:
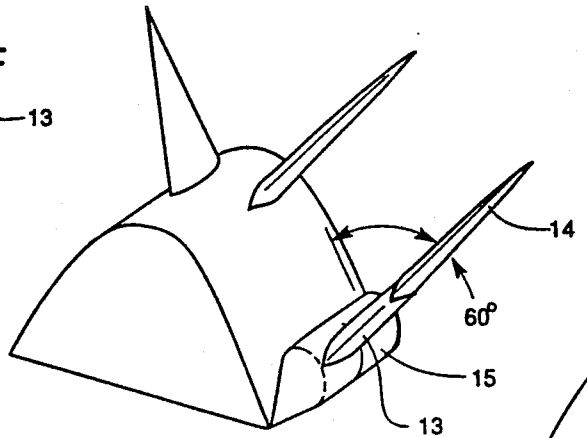
FIGS. 11–13 are schematic perspective views illustrating various stages of fin and control surface movement during the deployment cycle.
Figure 11:
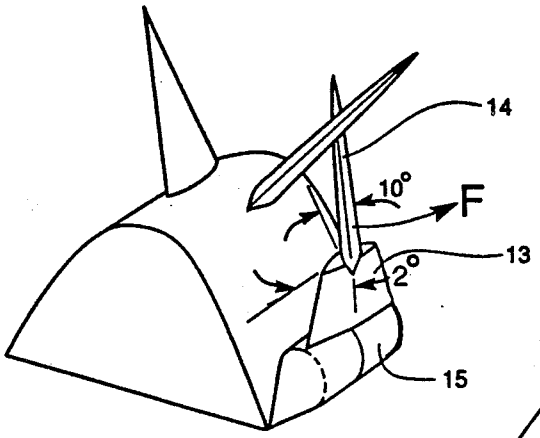
Figure 14:
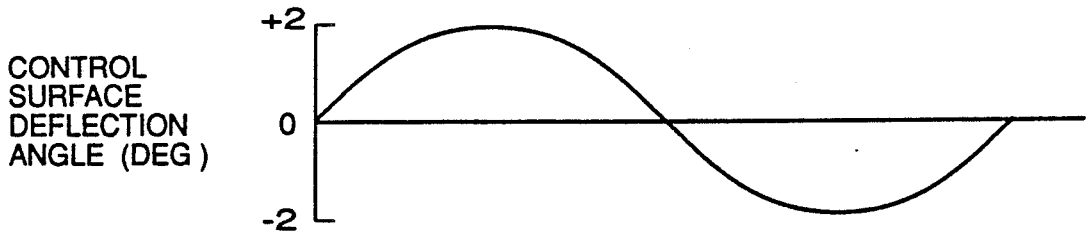
FIG. 14 is a graph representing the sinusoidal variation of control surface deflection during the deployment cycle.
Figure 15:
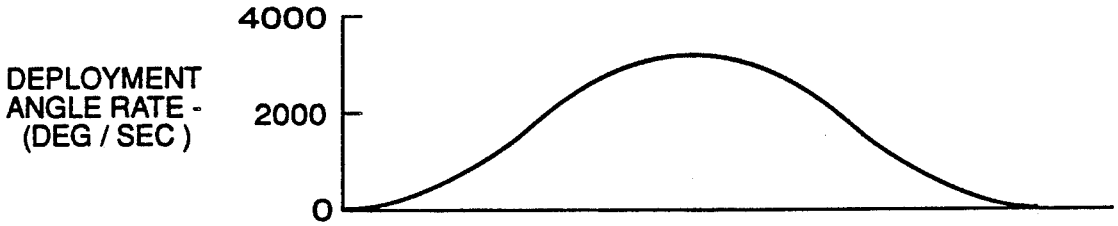
FIG. 15 is a graph representing the angular rate of deployment of the aerial vehicle's fin.
Figure 16:
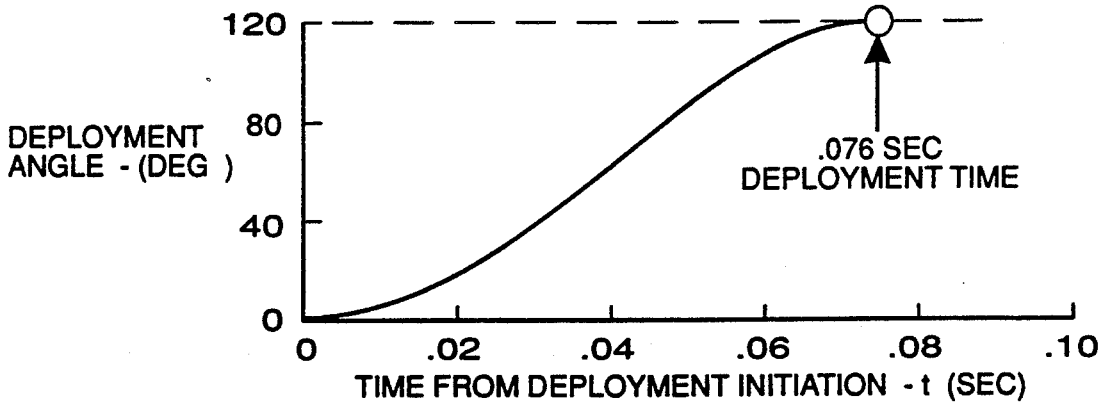
FIG. 16 is a graph representing the deployment angle of the fin versus time.

The 2° deflection of control surface 14 is reached at approximately ¼ of the unfold cycle within about 0.02 seconds (FIG. 16) and at about the time the fin 12 has been moved approximately 10°, as schematically depicted in FIG. 11 and shown graphically in FIG. 14. At this ¼ unfold cycle, the actuator 45 is energized to rotate drive shaft 49 in a clockwise direction reversing the direction of control surface deflection. However, the aerodynamic force F and resulting torque are still acting in the direction of unfold until control surface 14 has reached its normal or home position of zero (0°) deflection (FIG. 14) about half way through the unfold cycle (FIG. 12) within about 0.04 seconds (FIG. 16). As shown in FIG. 15, the angular rate of deployment has reached its maximum at this midpoint unfold cycle.

Figure 13:
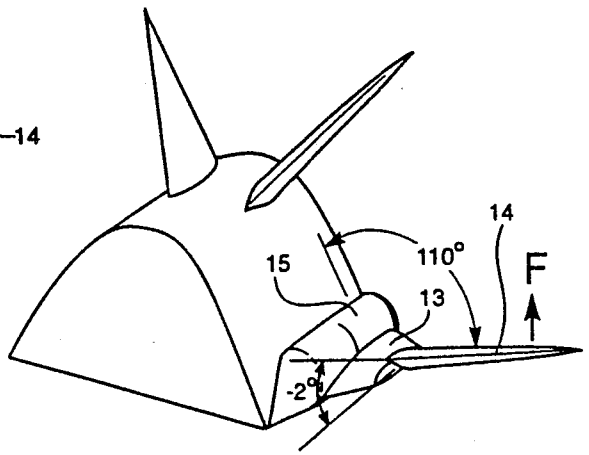

Continued rotation of drive shaft 49 in the clockwise direction just beyond the midpoint of the unfold cycle swings the control surface 14 past its home position (0° deflection) in the direction opposite to its initial direction until the control surface 14 reaches its maximum negative deflection of −2° as depicted in FIG. 13 and shown graphically in FIG. 14. This reverses the aerodynamic load F and torque to progressively slow the deployment angular rate (FIG. 15), in turn, reducing the deployment loads.

The maximum −2° deflection of control surface 14 is reached at approximately ¾ of the unfold cycle within about .06 seconds, FIGS. 13 and 14, at which time the stabilizer fin 12 has moved approximately 110°. At this ¾ unfold cycle, the actuator 45 is operative to reverse rotation of shaft 49 and return the control surface 14 back to its normal or home position of 0° deflection at about the time the stabilizer fin 12 reaches its fully deployed position (120°) shown in FIGS. 1 and 2. Thus, the aerodynamic force during the second half of the unfold cycle generates an aerodynamic load to gradually retard or decelerate the angular rate of deployment as the fin approaches its fully unfolded position. The reversed deflection airload provides a snubbing action to aid in arresting the fin 12 at the end of the deployment sequence and dramatically reduces the high shock load otherwise associated with power driven unfolding systems. The 120° deployment angle is traversed in less than one tenth of a second, approximately 0.076 seconds as depicted in FIG. 16. It has been found important to complete the fin deployment cycle within 0.10 seconds in order to ensure that the missile 10 can be brought under the normal missile autopilot/guidance system control before missile pitch divergence can occur. When the fin 12 reaches its fully deployed position, the lock pins 40 and 41, which were held in a retracted position by the opposite end walls of housing 15, snap into their respective openings 42 and 43 of housing 15 to maintain the fin 12 locked in such deployed position under the control of the missile autopilot/guidance system. When the aerosurface deployment cycle is completed, the missile guidance system is switched to the normal flight control mode.

From the foregoing, it is apparent that the objects of the invention have been fully accomplished. As a result of this invention, a new and improved apparatus and method is provided for deploying a pivotal aerosurface rapidly from a folded to an unfolded position. By forming the aerosurface with a base section and a control surface movable relative thereto, the latter can be angularly deflected in a predetermined first direction by separate activating means after initial aerosurface movement in order to induce aerodynamic loads or forces on the aerosurface in a manner assisting in the deployment and acceleration of the deployment rate. During the deployment cycle, the movable control surface is deflected in a direction opposite to the first direction to decelerate or retard the deployment rate in a manner bringing the aerosurface to its fully unfolded position smoothly without a severe end-of-stroke arresting load.

We claim:

1. An aerodynamic deployment apparatus comprising: an aerosurface mounted on an aerial vehicle for in-flight movement relative thereto from a folded position to an unfolded position; said aerosurface having a base member and a control surface; means mounting said base member on said aerial vehicle for pivotal movement relative thereto; said control surface mounted on said base member for movement relative thereto; actuating means for pivoting said base member to initiate deployment of said aerosurface at a predetermined angular rate; and means for deflecting said control surface successively in opposite directions relative to said base member during deployment to successively accelerate and decelerate said angular rate of deployment of said aerosurface.

2. An apparatus according to claim 1, including means for locking said control surface to said base member at said unfolded position of said aerosurface.

3. An apparatus according to claim 1, wherein said actuating means comprises an explosive pyrotechnic device.

4. An apparatus according to claim 1, wherein said base member includes a rotatable housing forming a part of the aerial vehicle's fairing, and said deflecting means includes an actuator contained within said housing.

5. A method of deploying a pivotal aerial vehicle aerosurface having a base member and a control surface, comprising the steps of: pivoting said aerosurface to initiate the deployment thereof from a folded position to an unfolded position at a predetermined angular rate of deployment, deflecting said control surface successively in opposite directions relative to aid base member for successively accelerating and decelerating the angular rate of deployment of said aerosurface.

6. A method according to claim 5, including at the further step of locking said control surface to said base member at said unfolded position of said aerosurface.

7. An aerodynamic deployment apparatus comprising: an aerosurface mounted on an aerial vehicle for in-flight movement relative thereto from a folded position to an unfolded position; said aerosurface having a base member and a control surface; means mounting said base member on said aerial vehicle for pivotal movement relative thereto; said control surface mounted on aid base member for movement relative thereto; actuating means for pivoting said base member to initiate deployment of said aerosurface at a predetermined angular rate; means for deflecting said control surface in one direction relative to said base member during deployment to impart aerodynamic loading forces against said aerosurface for accelerating said angular rate of deployment thereof, and said deflecting means being operative to deflect said control surface in a direction opposite to said one direction relative to said base member to impart aerodynamic loading forces against said aerosurface for decelerating said angular rate of deployment thereof as said aerosurface approaches said unfolded position.

8. An aerodynamic deployment apparatus comprising: an aerosurface mounted on an aerial vehicle for in-flight movement relative thereto from a folded position to an unfolded position; said aerosurface having a base member and a control surface; means mounting said base member on said aerial vehicle for pivotal movement relative thereto; said control surface mounted on said base member for movement relative thereto; actuating means for pivoting said base member to initiate deployment of said aerosurface at a predetermined angular rate; means for deflecting said control surface in one direction relative to said base member during deployment to impart aerodynamic loading forces against said aerosurface for accelerating said angular rate of deployment thereof, said base member including a rotatable housing forming a part of the aerial vehicle's fairing, and said deflecting means includes an actuator contained within said housing, a drive shaft extending through said base member and operatively connected at one end thereof to said actuator, and means releasably securing the other end of said drive shaft to said control surface.

9. A method of deploying a pivotal aerial vehicle aerosurface having a base member and a control surface, comprising the steps of: pivoting said aerosurface to initiate the deployment thereof from a folded position to an unfolded position at a predetermined angular rate of deployment, deflecting said control surface in one direction relative to said base member to impart aerodynamic forces against said aerosurface for accelerating the angular rate of deployment thereof, and deflecting said control surface in a direction opposite to said one direction relative to said base member to impart aerodynamic for es against said aerosurface or decelerating the angular rate of deployment thereof as said aerosurface approaches said unfolded position.

10. A method according to claim 9, including the further step of halting said aerosurface at said unfolded position with a minimal arresting load.

11. A method of deploying a pivotal aerial vehicle aerosurface having a base member and a control surface, comprising the steps of: pivoting said aerosurface to initiate the deployment thereof from a folded position to an unfolded position at a predetermined angular rate of deployment, deflecting said control surface in one direction relative to said base member to impart aerodynamic forces against said aerosurface for accelerating the angular rate of deployment thereof, said control surface being deflected 2° in said one direction relative to said base member to effect acceleration of said angular rate of deployment of said aerosurface.

12. A method according to claim 11, wherein said control surface is deflected 2° in said opposite direction relative to said base member to effect deceleration of said angular rate of deployment of said aerosurface and dampening the end-of-stroke arresting loads.

* * * * *